US008038399B1

(12) United States Patent
Liang

(10) Patent No.: US 8,038,399 B1
(45) Date of Patent: Oct. 18, 2011

(54) TURBINE RIM CAVITY SEALING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 565 days.

(21) Appl. No.: 12/276,325

(22) Filed: Nov. 22, 2008

(51) Int. Cl.
*F04D 29/10* (2006.01)
*F01D 5/08* (2006.01)
*F01D 11/00* (2006.01)

(52) U.S. Cl. ..... 416/95; 416/174; 415/230

(58) Field of Classification Search ..... None
See application file for complete search history.

(56) References Cited

U.S. PATENT DOCUMENTS 3,009,682 A * 11/1961 Johnson ..... 415/1
4,642,024 A * 2/1987 Weidner ..... 415/116
4,752,185 A * 6/1988 Butler et al. ..... 415/175
5,352,087 A * 10/1994 Antonellis ..... 415/115
5,749,701 A * 5/1998 Clarke et al. ..... 415/115
6,189,891 B1 * 2/2001 Tomita et al. ..... 277/414
6,398,488 B1 * 6/2002 Solda et al. ..... 415/115
6,899,520 B2 * 5/2005 Habedank et al. ..... 415/174.5
2008/0145208 A1 * 6/2008 Klasing et al. ..... 415/173.7

* cited by examiner

*Primary Examiner* — Scott B Geyer
(74) *Attorney, Agent, or Firm* — John Ryznic

(57) ABSTRACT

A rim cavity seal arrangement for a gas turbine engine, where the rim cavity is formed between two rotor disk stages with a stator vane assembly positioned between the rotor disks and extending into the rim cavity. A cover plate secured onto a side of the rotor disk includes a plurality of cooling air injectors directed to discharge cooling air into an annular groove formed on the underside of the vane endwall adjacent to the rotor disk to form an air cushion that seals the rim cavity from hot gas ingestion. The cover plate forms a cooling air supply passage with the rotor disk side to supply the injectors, and the cover plate includes at least one metering hole to meter the pressurized air into the injectors.

19 Claims, 2 Drawing Sheets

TURBINE RIM CAVITY SEALING

FEDERAL RESEARCH. STATEMENT

None.

CROSS-REFERENCE TO RELATED APPLICATIONS

None.

BACKGROUND OF THE INVENTION

1. Field of the Invention

The present invention relates generally to a gas turbine engine, and more specifically to a rim cavity sealing apparatus and process for the gas turbine engine.

2. Description of the Related Art Including Information Disclosed Under 37 CFR 1.97 and 1.98

A gas turbine engine, such as an industrial gas turbine (IGT) engine, includes a turbine section with multiple rows of stator vanes and rotor blades in which the stages of rotor blades rotate together around the stationary guide vane rows. The stator vanes extend into a rim cavity formed between two stages of the rotor blades as seen in FIG. 1. Seals are formed between the inner shrouds of the rotor blades and the stator vanes, and between the inner vane U-ring and the two rotor disk rim extensions. The hot gas flow pressure is higher on the forward side of the stator vanes than on the aft side, and thus a pressure differential exists within the rim cavity.

In the prior art, the U-ring attached to the bottom of the vane assembly is used in the IGT engine design for the control of leakage flow across the row of vanes. A single knife edge seal is used on the blade cover plate to produce a seal against the hot gas ingestion into the rim cavity. Hot gas ingestion into the rim cavity is prevented as much as possible because the rotor disks are made of relatively low temperature material than the airfoils. The high stresses operating on the rotor disks along with exposure to high temperatures will thermally weaken the rotor disk and shorten the life thereof. Purge cooling air discharge from the U-ring cavity has been used in the cooling of the U-ring seal as well as to purge the rim cavity of the hot gas flow ingestion. However, very little progress has been made in the control of rim cavity leakage flow distribution for the reduction of the total purge air demand, especially for a large IGT engine design application. Due to the large pressure differential between the front rim cavity and the of rim cavity, the front rim cavity requires a higher purge air pressure than the aft rim cavity to prevent the hot gas ingestion into the forward rim cavity. Cooling air for both the forward and aft sections of the rim cavity is provided from the same pressure source which is typically through the U-ring. An open gap in-between the U-ring and the rotor disk will result in a purge air mal-distribution. A majority of the purge air will pass through the sealing gap and exit from the aft section of the rim cavity. In some cases, hot gas ingestion into the front or forward section of the rim cavity will result in the purge air mal-distribution effect.

BRIEF SUMMARY OF THE INVENTION

It is an object of the present invention to provide for a gas turbine engine with a rim, cavity having improved sealing against ingestion of hot gas flow.

It is another object of the present invention to provide for a gas turbine engine a reduction in the demand for purge air flow into the rim cavity.

The present invention includes a cover plate with a fluid seal formed between the cover plate and the vane endwall. The cover plate includes an annular arrangement of injectors directed to inject cooling air toward an annular slot formed on the underside of the vane endwall to produce an air curtain in a rotational environment. The cooling air used for creating the air curtain is supplied from the dead rim cavity and through a metering hole formed in the cover plate. The rim cavity formed by a forward rotor disk assembly and an aft rotor disk assembly includes cover plates with cooling air injectors on both sides of the rim cavity.

DETAILED DESCRIPTION OF THE INVENTION

Figure 1:
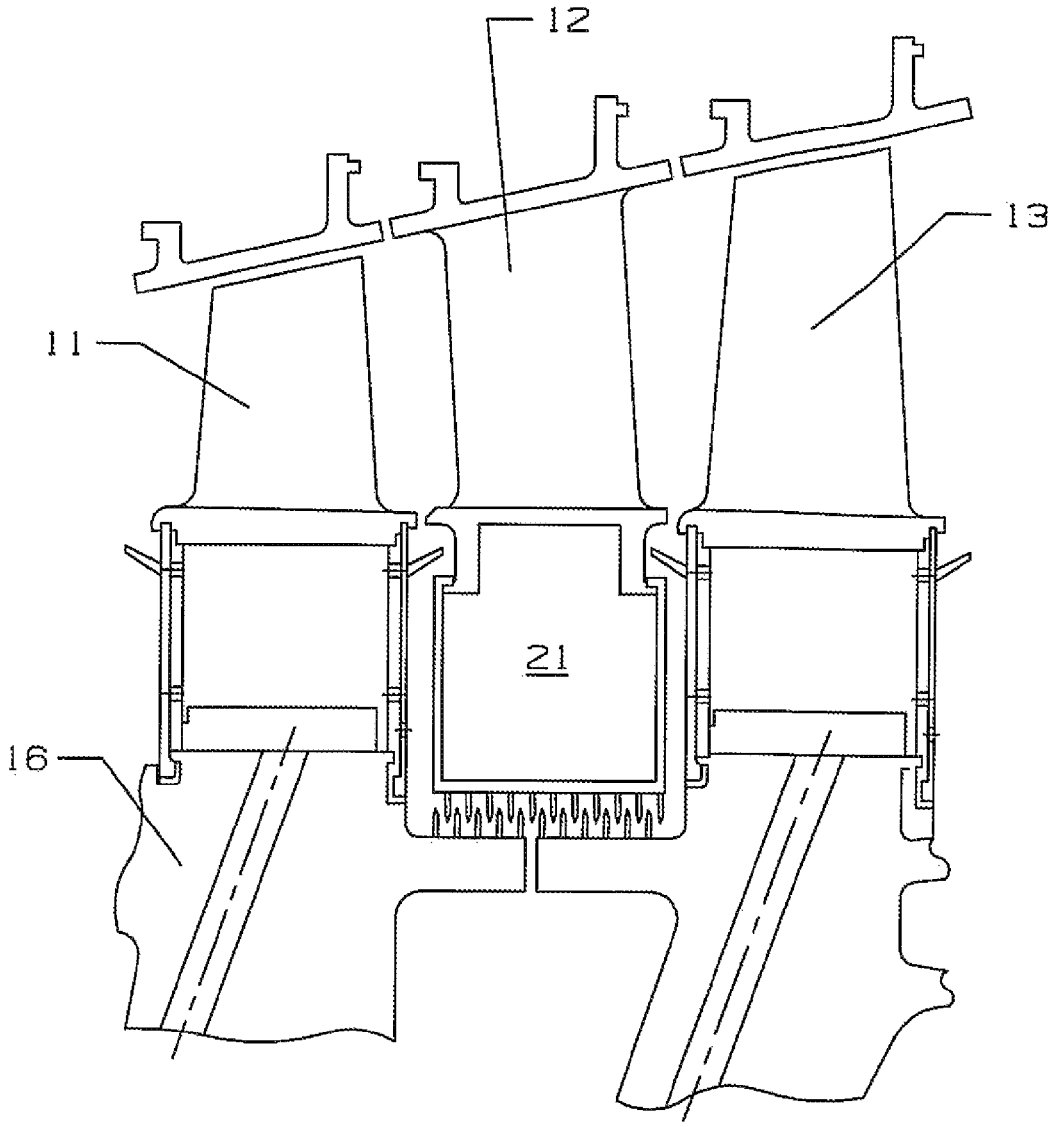
Prior Art Fig 1
FIG. 1 shows a cross section view of a rim cavity in a gas turbine engine of the prior art.
Figure 2:
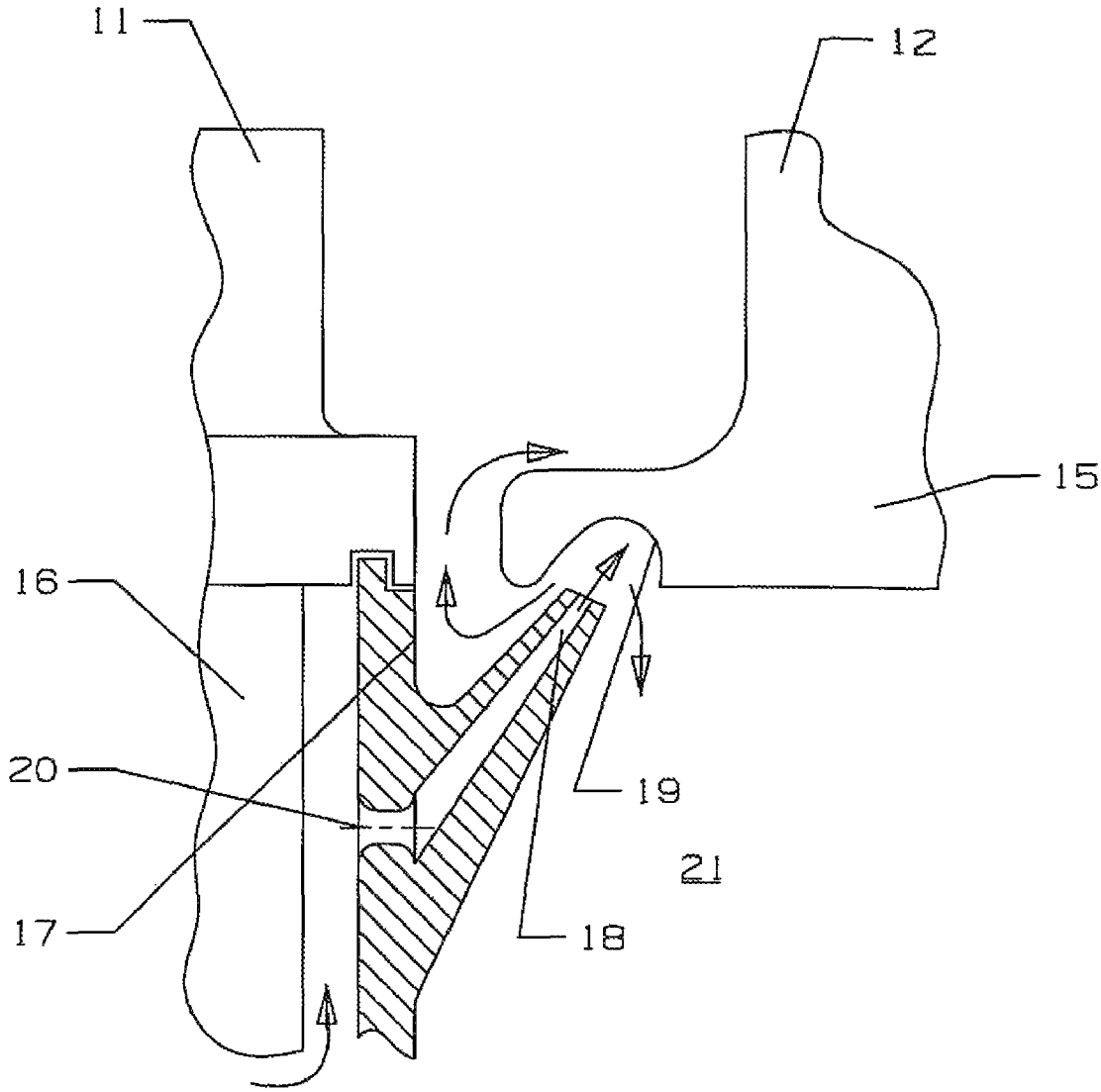
FIG. 2 shows a detailed view of the purge air injector on the cover plate of the present invention.

The present invention is a air injector arrangement for use in a rim cavity assembly of the gas turbine engine rim cavity sealing arrangement of FIG. 1 with a modification that is shown in FIG. 2. The rotor disk assembly includes a forward rotor blade 11, followed by a stator vane 12 and then an aft rotor blade 13. The stator vane 12 includes an endwall or inner shroud 15 that forms a seal with the forward and aft rotor blades 11 and 13. The rotor blade 11 extends from a rotor disk 16, and includes a plurality of cover plate segments secured on the side of the rotor disk facing the rim cavity 21 as seen in FIG. 2. The cover plate 17 includes an air injector 18 with an opening hole at the end to discharge cooling air into an annular groove 19 formed on the underside of the vane endwall 15. A plurality of metering holes 20 are formed in the cover plate 17 to meter cooling air from a dead rim cavity and into the cooling air channel formed within the injector 18.

The cooling air injector 18 is an annular ring arranged around the inner side of the cover plates that form a full 360 degree annular injector assembly with a plurality of injector passages with openings directed to discharge the cooling air into the annular V-notch cross sectional shaped groove 19 to form the air curtain in the seal. The annular injector ring that has the individual injector passages within also forms a knife edge like seal in that no openings or passages exist within the annular ring. The only path for gas flow leakage would be through the gap formed between the injector tip (where the hole opens) and the vane endwall surface. The annular injector ring extends upward and toward the rim cavity at around 45 degrees from the engine rotational axis. The injector on the first cover plate injects the cooling air upward and aft at around 45 degrees, while the injector on the second cover plate injects or discharges the air upward and forward at 45 degrees.

Also, both sides of the rim cavity 21 can make use of the air injectors. The forward rotor disk and the aft rotor disk assemblies both have cover plates with injector passages to discharge the cooling air into forward and aft annular grooves both formed on the underside of the vane endwall. the forward cover plate will include injectors directed to discharge cooling air into a forward annular groove on the forward side of the vane endwall 15, and the aft cover plate with include injectors directed to discharge cooling air into an aft annular groove formed on the underside of the vane endwall 15 on the aft side. Rotation of the rotor disks—and, thus the cover plates—will force the cooling air through the injector passages 18 and into the annular grooves 19. The annular groove 19 underneath the vane endwall 15 can have various shapes as long as the shape will allow for a buildup of air to form an "air curtain" that will reduce hot gas ingestion.

The fluid sealing apparatus of the present invention provides for a reduction of the turbine rim cavity total purge air flow demand and minimizes the hot gas ingestion into the rim cavity over the prior art rim cavity sealing arrangement in FIG. 1. The passive fluid rim cavity sealing arrangement is formed into the blade cover plate and at the end of a knife edge seal. Also, a V-notch groove is formed on the underside of the vane endwall so that the knife edge will overlap the groove.

The cover plate structure is attached onto the rotor disk to provide the basic support arrangement. A front rim cavity cover plate and an aft rim cavity cover plate are used on both sides of the rim cavity. Blade cooling air and purge air are provided from the blade live rim cavity and supply through the cooling air delivery channels on the front side of the blade rotor. A portion of the cooling air is used for the cooling of the blade. A portion of the cooling air is channeled through the gap in-between the cover plate and the blade attachment and into the blade dead rim cavity for the cooling of the blade platform. A portion of the air is then channeled into the knife edge or injectors to discharge the cooling air into the annular groove and form a fluidic seal for the rim cavity.

During engine operation, an air curtain is formed within the V-shaped annular groove by the impingement jet of air that is discharged from the knife edge or injectors and into the annular groove. The effective leakage flow area is reduced by the formation of an air curtain. A reduction of purge air demand as well as minimizing the possibility of hot gas ingestion is achieved. Also, the impingement jet also provides cooling for the injectors or knife edge and the vane endwall section. An additional benefit for the fluidic seal is a reduced sensitivity for the seal gap dimensional change during engine operation as thermal growth changes the gaps.

I claim the following:

1. A gas turbine engine comprising:

a first rotor disk with a row of first rotor blades extending into a hot gas flow path;

a second rotor disk with a row of second rotor blades extending into the hot gas flow path;

a first stator vane assembly positioned between the first and second rows of rotor blades;

an annular groove formed on an underside of an endwall of the first stator vane assembly;

a first cover plate secured to the first rotor disk; and, a cooling air injector extending out from the first cover plate and directed to discharge cooling air into the annular groove to form a fluid seal for a rim cavity.

2. The gas turbine engine of claim 1, and further comprising:

the cooling air injector is an annular injector with a plurality of separate injectors all directed to discharge cooling air into the annular groove.

3. The gas turbine engine of claim 1, and further comprising:

the annular groove is located adjacent to the forward end of the endwall.

4. The gas turbine engine of claim 1, and further comprising:

the cover plate includes a metering hole to meter cooling air into the injector.

5. The gas turbine engine of claim 1, and further comprising:

the cover plate forms a cooling air supply passage with the side of the first rotor disk for the injector.

6. The gas turbine engine of claim 1, and further comprising:

the annular groove has a V-shaped cross section.

7. The gas turbine engine of claim 1, and further comprising:

the second rotor disk includes a second cover plate with a second cooling air injector extending out from the second cover plate and directed to discharge cooling air into a second annular groove formed on the underside of the endwall adjacent to the second rotor disk to form a second fluid seal for the rim cavity.

8. The gas turbine engine of claim 1, and further comprising:

the first vane stator assembly includes a U-ring extending toward rotor disk extensions to form a labyrinth seal in the rim cavity.

9. The gas turbine engine of claim 1, and further comprising:

cooling air injector extends out from the first cover plate upward and aft at around 45 degrees from the engine rotational axis.

10. A process for sealing a rim cavity in a multiple staged turbine of a gas turbine engine, the turbine having a first rotor disk and a second rotor disk, a first vane assembly positioned between the two rotor disks, and a rim cavity formed between the two rotor disks, the process comprising the steps of:

supplying pressurized cooling air to a dead rim cavity of the turbine;

metering the pressurized cooling air from the dead rim cavity through a cover plate; and, discharging the metered cooling air from the cover plate into an annular groove formed underneath the stator vane endwall to form a fluid air cushion to reduce hot gas ingestion into the rim cavity.

11. The process for sealing a rim cavity of claim 10, and further comprising the step of:

discharging the metered cooling air from a plurality of locations from the cover plate and into the annular groove.

12. The process for sealing a rim cavity of claim 10, and further comprising the step of:

supplying pressurized cooling air to a second dead rim cavity of the turbine;

metering the pressurized cooling air from the second dead rim cavity through a second cover plate located on the other side of the rim cavity; and, discharging the metered cooling air from the second cover plate into a second annular groove formed underneath the stator vane endwall to form a second fluid air cushion to reduce hot gas ingestion into the rim cavity.

13. The process for sealing a rim cavity of claim 11, and further comprising the step of:

Discharging the metered cooling air upward and toward the rim cavity at around 45 degrees from the engine rotational axis.

14. A rim cavity in a gas turbine engine comprising:

a rotor disk with a cover plate secured on a side;

a stator vane endwall adjacent to the rotor disk;

an annular groove formed on an underside of the vane endwall; and, a cooling air injector extending from the cover plate and directed to discharge cooling air into the annular groove to form an air cushion.

15. The rim cavity of claim 14, and further comprising:

the cover plate includes a plurality of cooling air injectors all directed to discharge cooling air into the annular groove.

16. The rim cavity of claim 14, and further comprising: the cover plate includes at least one metering hole to meter cooling air into the injector.

17. The rim cavity of claim 14, and further comprising: the annular groove has a V-shape cross section.

18. The rim cavity of claim 14, and further comprising: the injector is an annular shape with a plurality of injectors.

19. The rim cavity of claim 14, and further comprising: the cooling air injector discharges the cooling air upward and toward the rim cavity at around 45 degrees from the engine rotational axis.

* * * * *